US009578730B2

(12) United States Patent
Abe et al.

(10) Patent No.: US 9,578,730 B2
(45) Date of Patent: Feb. 21, 2017

(54) EXTREME ULTRAVIOLET LIGHT GENERATION APPARATUS AND EXTREME ULTRAVIOLET LIGHT GENERATION SYSTEM

(71) Applicant: Gigaphoton Inc., Tochigi (JP)

(72) Inventors: Tamotsu Abe, Oyama (JP); Osamu Wakabayashi, Oyama (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 14/995,636

(22) Filed: Jan. 14, 2016

(65) Prior Publication Data

US 2016/0135276 A1 May 12, 2016

Related U.S. Application Data

(63) Continuation of application No. PCT/JP2013/072874, filed on Aug. 27, 2013.

(51) Int. Cl.
*H05G 2/00* (2006.01)

(52) U.S. Cl.
CPC ..... *H05G 2/008* (2013.01); *H05G 2/003* (2013.01)

(58) Field of Classification Search
USPC ..... 250/504 R, 493.1
See application file for complete search history.

(56) References Cited

U.S. PATENT DOCUMENTS

2004/0195529 A1 10/2004 Hergenhan et al.
2007/0280308 A1 12/2007 Ershov et al.
2008/0197297 A1* 8/2008 Akins ..... B82Y 10/00 250/504 R
2010/0090133 A1* 4/2010 Endo ..... G03F 7/70033 250/504 R
2010/0258750 A1* 10/2010 Partlo ..... H05G 2/003 250/504 R
2012/0175533 A1 7/2012 Moriya et al.
2012/0228525 A1* 9/2012 Moriya ..... H05G 2/003 250/504 R (Continued)

FOREIGN PATENT DOCUMENTS

JP 2004-303725 A 10/2004
JP 2007-109451 A 4/2007

(Continued)

OTHER PUBLICATIONS

International Search Report—PCT/JP2013/072874 mailed Oct. 15, 2013.

*Primary Examiner* — Phillip A Johnston
*Assistant Examiner* — Hsien Tsai
(74) *Attorney, Agent, or Firm* — Studebaker & Brackett PC

(57) ABSTRACT

An extreme ultraviolet light generation apparatus may include: a chamber; a target generation unit configured to output a target to a predetermined region inside the chamber; a focusing optical system configured to concentrate a pulse laser beam to the predetermined region; and a plurality of scattered light detectors each configured to detect scattered light from the target irradiated with the pulse laser beam. The extreme ultraviolet light generation apparatus may further include: an optical path changer configured to change an optical path of the pulse laser beam; and an optical path controller configured to control the optical path changer on a basis of results of detection by the plurality of scattered light detectors.

19 Claims, 13 Drawing Sheets

(56) References Cited

U.S. PATENT DOCUMENTS

| | | | |
|---|---|---|---|
| 2013/0043401 | A1 | 2/2013 | Graham et al. |

FOREIGN PATENT DOCUMENTS

| | | | |
|---|---|---|---|
| JP | 2007-528607 | A | 10/2007 |
| JP | 2010-103499 | A | 5/2010 |
| JP | 2012-147022 | A | 8/2012 |
| JP | 2012-199512 | A | 10/2012 |
| JP | 2013-093308 | A | 5/2013 |
| WO | 2011/013779 | A1 | 2/2011 |
| WO | 2013/050842 | A1 | 4/2013 |

* cited by examiner

EXTREME ULTRAVIOLET LIGHT GENERATION APPARATUS AND EXTREME ULTRAVIOLET LIGHT GENERATION SYSTEM

TECHNICAL FIELD

The present disclosure relates to an extreme ultraviolet light generation apparatus and an extreme ultraviolet light generation system.

BACKGROUND ART

In recent years, as semiconductor processes become finer, transfer patterns for use in photolithographies of semiconductor processes have rapidly become finer. In the next generation, microfabrication at 70 nm to 45 nm, and further, microfabrication at 32 nm or less will be demanded. In order to meet the demand for microfabrication at 32 nm or less, for example, the development of an exposure apparatus in which a system for generating EUV light at a wavelength of approximately 13 nm is combined with a reduced projection reflective optical system is expected.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using orbital radiation.

SUMMARY

An extreme ultraviolet light generation apparatus according to an aspect of the present disclosure may include: a chamber; a target generation unit configured to output a target to a predetermined region inside the chamber; a focusing optical system configured to concentrate a pulse laser beam to the predetermined region; and a plurality of scattered light detectors each configured to detect scattered light from the target irradiated with the pulse laser beam.

An extreme ultraviolet light generation system according to another aspect of the present disclosure may include: a first laser apparatus configured to output a first pulse laser beam; a second laser apparatus configured to output a second pulse laser beam; a chamber; a target generation unit configured to output a target into the chamber; a focusing optical system configured to concentrate the first pulse laser beam to the target and concentrate the second pulse laser beam to a secondary target that is formed by the target being irradiated with the first pulse laser beam; a laser controller configured to control the first laser apparatus and the second laser apparatus so that the target is irradiated with the first pulse laser beam and the secondary target is irradiated with the second pulse laser beam; and a plurality of scattered light detectors each configured to detect both scattered light from the target irradiated with the first pulse laser beam and scattered light from the secondary target irradiated with the second pulse laser beam.

An extreme ultraviolet light generation system according to another aspect of the present disclosure may include: a first laser apparatus configured to output a first pulse laser beam; a second laser apparatus configured to output a second pulse laser beam; a chamber; a target generation unit configured to output a target into the chamber; a focusing optical system configured to concentrate the first pulse laser beam to the target and concentrate the second pulse laser beam to a secondary target that is formed by the target being irradiated with the first pulse laser beam; a laser controller configured to control the first laser apparatus and the second laser apparatus so that the target is irradiated with the first pulse laser beam and the secondary target is irradiated with the second pulse laser beam; a plurality of first scattered light detectors each configured to detect scattered light from the target irradiated with the first pulse laser beam; and a plurality of second scattered light detectors each configured to detect scattered light from the secondary target irradiated with the second pulse laser beam.

BRIEF DESCRIPTION OF DRAWINGS

Hereinafter, selected embodiments of the present disclosure will be described with reference to the accompanying drawings by way of example.

DESCRIPTION OF EMBODIMENTS

Contents

Figure 1:
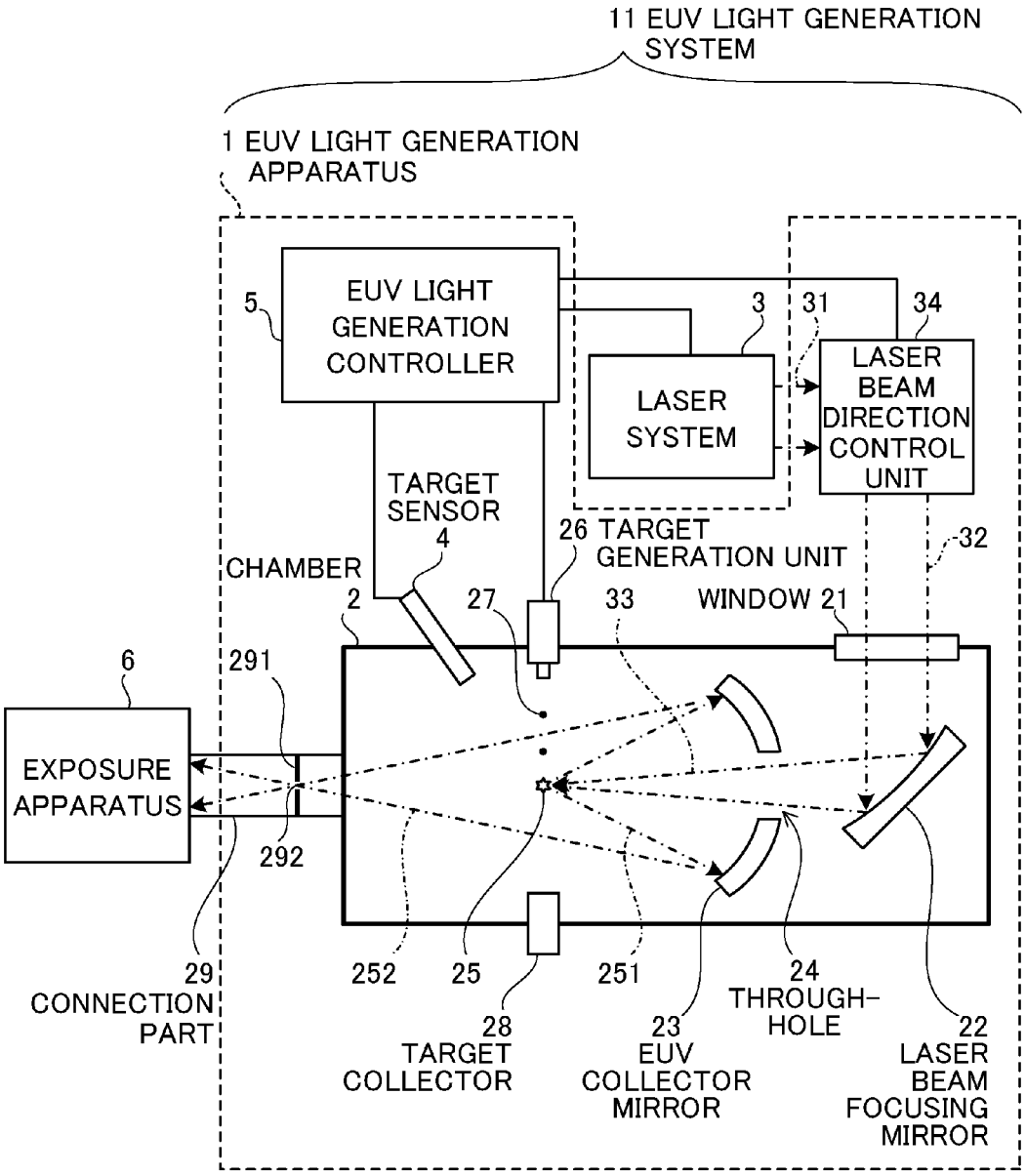
FIG. 1 schematically illustrates an exemplary configuration of an LPP type EUV light generation system.

1. Overview
2. Terms
3. Overview of Extreme Ultraviolet Light Generation System
3.1 Configuration
3.2 Operation
4. Extreme Ultraviolet Light Generation Apparatus Including Scattered Light Detectors
4.1 Configuration
4.2 Operation
4.3 Control of Optical Path of Pulse Laser Beam
5. Extreme Ultraviolet Light Generation System Including Pre-pulse Laser Device
5.1 Configuration
5.2 Control of Optical Paths of Pulse Laser Beams
6. Modifications
6.1 Example of Scattered Light Detector
6.2 Example Arrangement of Three Scattered Light Detectors
6.3 Example Arrangement of Four Scattered Light Detectors
7. Configuration of Controller Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Corresponding elements may be referenced by corresponding reference numerals and characters, and duplicate descriptions thereof will be omitted herein.

1. Overview

In an LPP-type EUV light generation apparatus, a target generation unit may output a target so that the target reaches a plasma generation region. By a laser system irradiating the target with a pulse laser beam at the point in time when the target reaches the plasma generation region, the target may be turned into plasma and EUV light may be emitted from the plasma.

It is desirable that a center of the target and an optical path axis of the pulse laser beam substantially coincide with each other when the laser system irradiates the target with the pulse laser beam. However, it is not easy to irradiate the target, which has been outputted from the target generation unit and is passing through the plasma generation region, with the pulse laser beam in a high accuracy.

According to an aspect of the present disclosure, a plurality of scattered light detectors may be used to detect scattered light of the pulse laser beam, thereby detecting whether or not the center of the target and the optical path axis of the pulse laser beam coincide with each other.

According to another aspect of the present disclosure, an optical path changer may be used to change the optical path of the pulse laser beam and an optical path controller may be used to control the optical path changer on the basis of results of detection by the plurality of scattered light detectors. The optical path of the pulse laser beam may be thereby changed so that the center of the target and the optical path axis of the pulse laser beam substantially coincide with each other.

2 Terms

Several terms used in the present application will be described hereinafter.

A "trajectory" of a target may be an ideal path of a target outputted from a target generation unit, or may be a path of a target according to the design of a target generation unit.

An "actual path" of the target may be a path of a target actually outputted from the target generation unit.

A "plasma generation region 25" may refer to a predetermined region where the generation of plasma for generating EUV light begins.

An "optical path axis" of a pulse laser beam may refer to a central axis of an optical path of the pulse laser beam.

3. Overview of EUV Light Generation System 3.1 Configuration

FIG. 1 schematically illustrates an exemplary configuration of an LPP type EUV light generation system. An EUV light generation apparatus 1 may be used with at least one laser system 3. Hereinafter, a system that includes the EUV light generation apparatus 1 and the laser system 3 may be referred to as an EUV light generation system 11. As shown in FIG. 1 and described in detail below, the EUV light generation apparatus 1 may include a chamber 2 and a target generation unit 26. The chamber 2 may be sealed airtight. The target generation unit 26 may be mounted onto the chamber 2, for example, to penetrate a wall of the chamber 2. A target material to be supplied by the target generation unit 26 may include, but is not limited to, tin, terbium, gadolinium, lithium, xenon, or a combination of any two or more of them.

The chamber 2 may have at least one through-hole formed in its wall. A window 21 may be located at the through-hole. A pulse laser beam 32 that is outputted from the laser system 3 may travel through the window 21. In the chamber 2, an EUV collector mirror 23 having a spheroidal reflective surface may be provided. The EUV collector mirror 23 may have a first focusing point and a second focusing point. The reflective surface of the EUV collector mirror 23 may have a multi-layered reflective film in which molybdenum layers and silicon layers are alternately laminated, for example. The EUV collector mirror 23 may be positioned such that the first focusing point is positioned in a plasma generation region 25 and the second focusing point is positioned in an intermediate focus (IF) region 292. The EUV collector mirror 23 may have a through-hole 24, formed at the center thereof, through which a pulse laser beam 33 travels.

The EUV light generation apparatus 1 may further include an EUV light generation controller 5 and a target sensor 4. The target sensor 4 may have an imaging function and detect at least one of the presence, actual path, position, and speed of a target 27.

Further, the EUV light generation apparatus 1 may include a connection part 29 for allowing the interior of the chamber 2 to be in communication with the interior of an exposure apparatus 6. A wall 291 having an aperture may be provided in the connection part 29. The wall 291 may be positioned such that the second focus position of the EUV collector mirror 23 lies in the aperture formed in the wall 291.

The EUV light generation apparatus 1 may also include a laser beam direction control unit 34, a laser beam focusing mirror 22, and a target collector 28 for collecting targets 27. The laser beam direction control unit 34 may include an optical element for defining the direction in which the pulse laser beam travels and an actuator for adjusting the position and the orientation or posture of the optical element.

3.2 Operation

With reference to FIG. 1, a pulse laser beam 31 outputted from the laser system 3 may pass through the laser beam direction control unit 34 and be outputted therefrom as the pulse laser beam 32. The pulse laser beam 32 may travel through the window 21 and enter the chamber 2. The pulse laser beam 32 may travel inside the chamber 2 along at least one beam path, be reflected by the laser beam focusing mirror 22, and strike at least one target 27 as a pulse laser beam 33.

The target generation unit 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and emitted light 251 may be emitted from the plasma. The EUV light included in the emitted light 251 may be reflected at a higher reflectance than light at other wavelength regions by the EUV collector mirror 23. Reflected light 252, which includes the EUV light reflected by the EUV collector mirror 23, may be concentrated to the intermediate focus region 292 and be outputted to the exposure apparatus 6. Here, one target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of the timing when the target 27 is outputted and the direction in which the target 27 is outputted. Furthermore, the EUV light generation controller 5 may be configured to control at least one of the timing when the laser system 3 oscillates, the direction in which the pulse laser beam 32 travels, and the position at which the pulse laser beam 33 is focused. The various controls mentioned above are merely examples, and other controls may be added as necessary.

Figure 2:
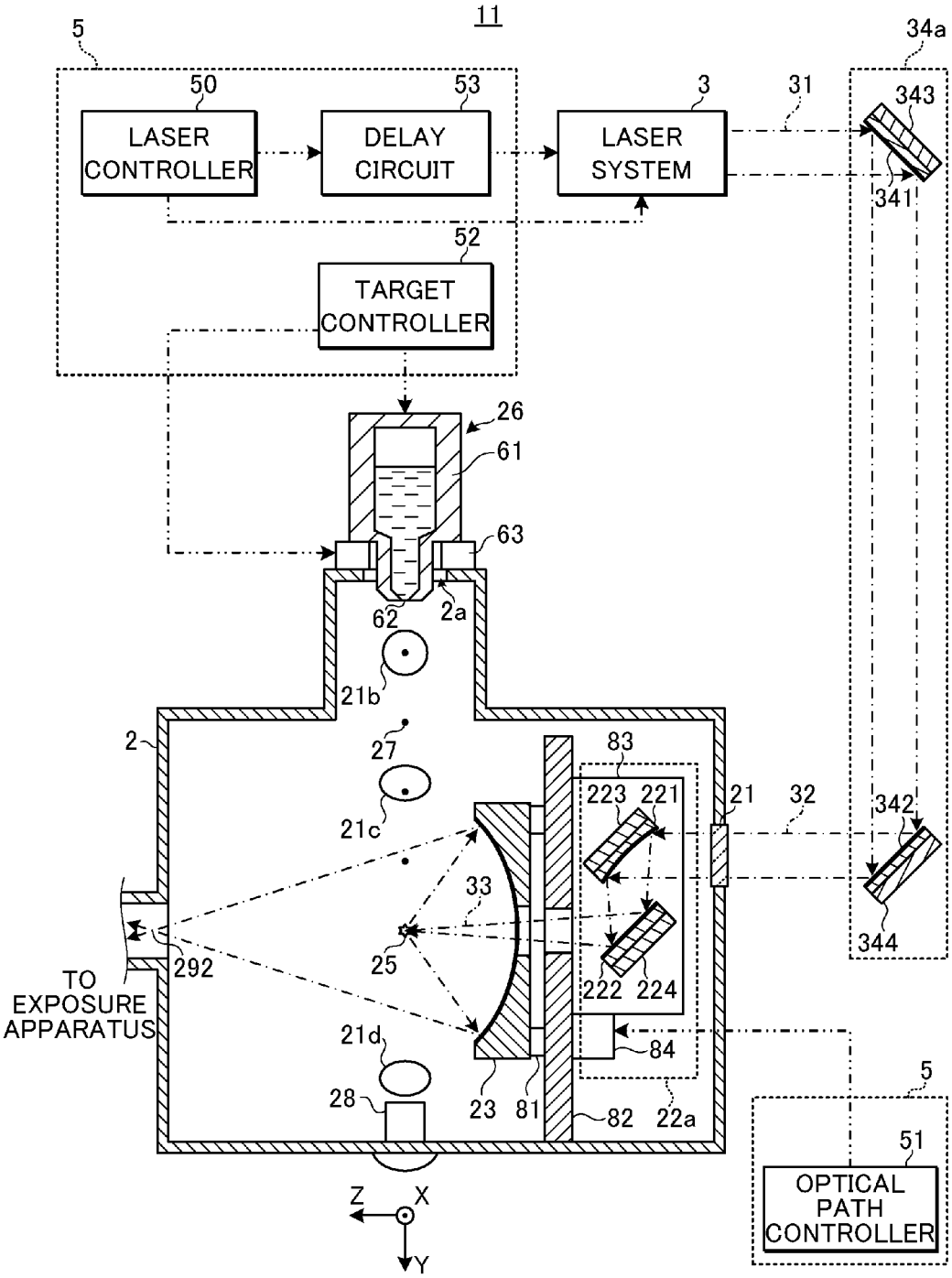
FIG. 2 is a partial cross-sectional view illustrating a configuration of an EUV light generation system according to a first embodiment.
Figure 3:
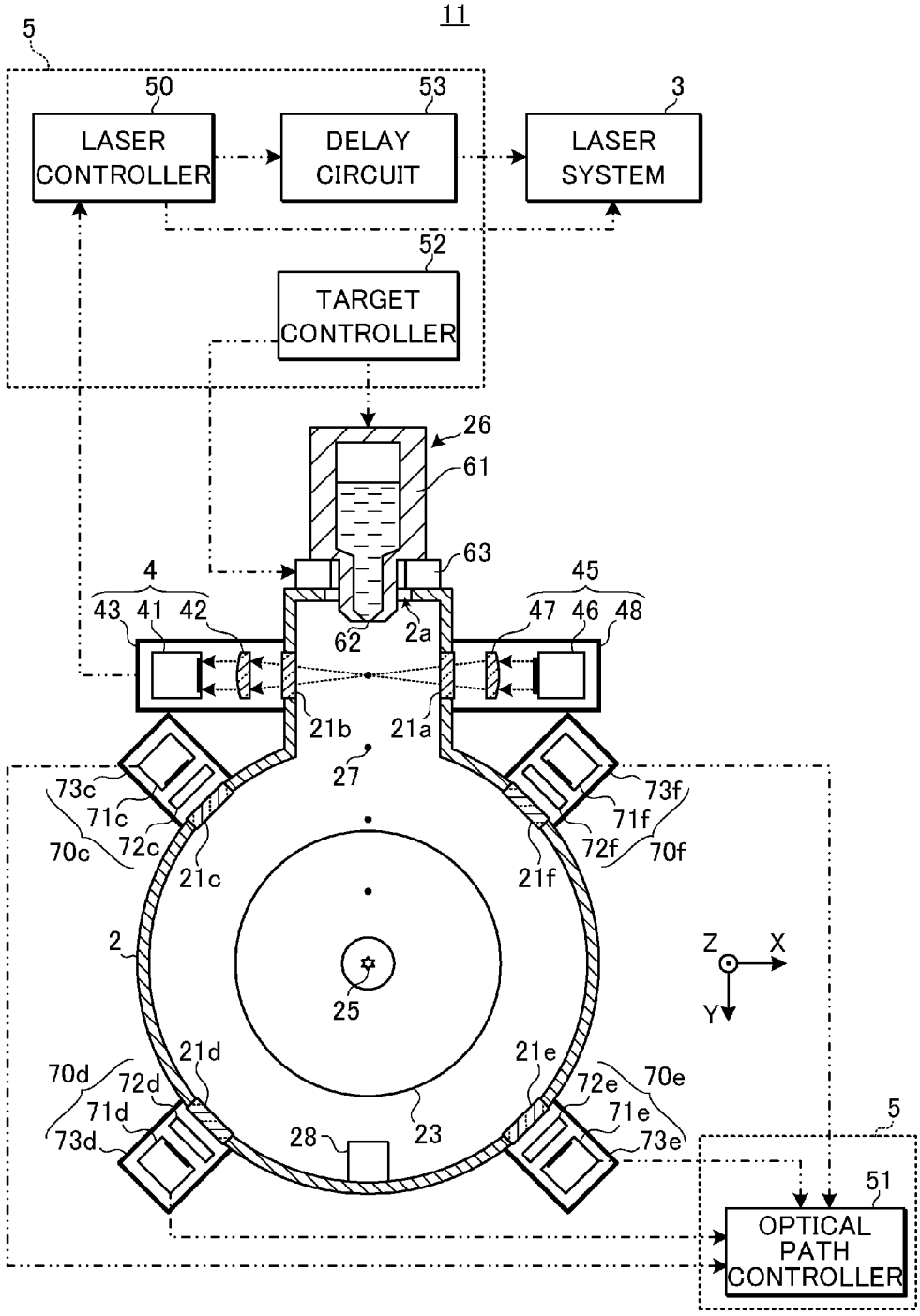
FIG. 3 is a partial cross-sectional view illustrating the configuration of the EUV light generation system according to the first embodiment.

4. EUV Light Generation Apparatus Including Scattered Light Detectors 4.1 Configuration FIGS. 2 and 3 are partial cross-sectional views illustrating a configuration of an EUV light generation system 11 according to a first embodiment. In the following description, a Y direction may substantially coincide with a direction of movement of a target 27. A Z direction may substantially coincide with a traveling direction of a pulse laser beam 33. An X direction may be a direction perpendicular to both the Y direction and the Z direction and perpendicular to the plane of paper in FIG. 2.

FIG. 2 shows a cross-section taken along a plane including both a trajectory of a target 27 and an optical path axis of a pulse laser beam 33. The plane including both the trajectory of the target 27 and the optical path axis of the pulse laser beam 33 may be a plane parallel to a YZ plane. FIG. 3 shows a cross-section taken along a plane including the trajectory of the target 27 and perpendicular to the optical path axis of the pulse laser beam 33. The plane including the trajectory of the target 27 and perpendicular to the optical path axis of the pulse laser beam 33 may be a plane parallel to an XY plane.

As shown in FIG. 2, a focusing optical system 22*a*, the EUV collector mirror 23, the target collector 28, an EUV collector mirror holder 81, plates 82 and 83, and an optical path changer 84 may be provided within the chamber 2. As shown in FIG. 3, the target generation unit 26, the target sensor 4, a light-emitting unit 45, and a plurality of scattered light detectors 70*c*, 70*d*, 70*e*, and 70*f* may be attached to the chamber 2.

The laser system 3, a laser beam direction control unit 34*a*, and the EUV light generation controller 5 may be provided outside the chamber 2. The EUV light generation controller 5 may include a laser controller 50, an optical path controller 51, a target controller 52, and a delay circuit 53.

The target generation unit 26 may include a reservoir 61. The reservoir 61 may hold a target material in a melted state in its interior. The target material may be kept at a temperature equal to or higher than its melting point by a heater (not shown) attached to the reservoir 61. A part of the reservoir 61 may be inserted into a through-hole 2*a* formed in a wall of the chamber 2 so that an end of the reservoir 61 is positioned inside the chamber 2. An opening 62 may be formed at the end of the reservoir 61.

The target generation unit 26 may further include a dual-axis stage 63. The dual-axis stage 63 may be capable of moving the reservoir 61 and the opening 62 in a Z axis direction and an X axis direction relative to the chamber 2. This may enable the dual-axis stage 63 to adjust the trajectory of the target 27. A sealing means (not shown) may be disposed between the wall of the chamber 2 on the periphery of the through-hole 2*a* and the reservoir 61. This sealing means may form an airtight seal between the wall of the chamber 2 on the periphery of the through-hole 2*a* and the reservoir 61.

The target sensor 4 and the light-emitting unit 45 may be disposed on opposite sides to each other with the trajectory of the target 27 therebetween. Windows 21*a* and 21*b* may be attached to the chamber 2. The window 21*a* may be positioned between the light-emitting unit 45 and the trajectory of the target 27. The window 21*b* may be positioned between the trajectory of the target 27 and the target sensor 4.

The target sensor 4 may include an optical sensor 41, a focusing optical system 42, and a container 43. The container 43 may be fixed to an outer part of the chamber 2. In the container 43, the optical sensor 41 and the focusing optical system 42 may be fixed. The light-emitting unit 45 may include a light source 46, a focusing optical system 47, and a container 48. The container 48 may be fixed to an outer part of the chamber 2. In the container 48, the light source 46 and the focusing optical system 47 may be fixed.

Output light from the light source 46 may be focused by the focusing optical system 47 on the trajectory of the target 27 between the target generation unit 26 and the plasma generation region 25 and an area therearound. When the target 27 passes through a position at which light emitted by the light-emitting unit 45 is focused, the target sensor 4 may detect a change in light intensity of light passing through the trajectory of the target 27 and the area therearound by using the optical sensor 41. The target sensor 4 may output the change in light intensity as a target detection signal to the laser controller 50 of the EUV light generation controller 5.

The laser system 3 may include a $CO_2$ laser device. The laser system 3 may output a pulse laser beam in accordance with control exercised by the laser controller 50 of the EUV light generation controller 5.

The laser beam direction control unit 34*a* may include high-reflecting mirrors 341 and 342. The high-reflecting mirrors 341 and 342 may be supported by holders 343 and 344, respectively.

The plate 82 may be fixed to the chamber 2. The plate 83 may be supported by the plate 82. The focusing optical system 22*a* may include an off-axis paraboloid mirror 221 and a flat mirror 222. The off-axis paraboloid mirror 221 and the flat mirror 222 may be supported by holders 223 and 224, respectively. The holders 223 and 224 may be fixed to the plate 83.

The optical path changer 84 may be capable of changing the position of the plate 83 relative to the plate 82 in accordance with a control signal that is outputted from the optical path controller 51 of the EUV light generation controller 5. By changing the position of the plate 83, the positions of the off-axis paraboloid mirror 221 and the flat mirror 222 may be changed. This may result in a change in the optical path of the pulse laser beam 33 reflected by the off-axis paraboloid mirror 221 and the flat mirror 222.

As shown in FIG. 3, the plurality of scattered light detectors 70*c* to 70*f* may be arranged on the plane parallel to the XI plane in such a manner as to be positioned at substantially equal distances from the plasma generation region 25. As seen from the plasma generation region 25, optical sensors 71*c*, 71*d*, 71*e*, and 71*f* may be positioned in directions tilted at approximately 45 degrees to an XZ plane and the YZ plane.

The plurality of scattered light detectors 70*c* to 70*f* may include the optical sensors 71*c* to 71*f*, band-pass filters 72*c*, 72*d*, 72*e*, and 72*f*, and containers 73*c*, 73*d*, 73*e*, and 73*f*, respectively. The containers 73*c* to 73*f* may be fixed to the outer part of the chamber 2. The optical sensors 71*c* to 71*f* and the band-pass filters 72*c* to 72*f* may be fixed in the containers 73*c* to 73*f*, respectively.

The optical sensors 71*c* to 71*f* may be disposed so that their light-receiving surfaces face the plasma generation region 25. The optical sensors 71*c* to 71*f* may be photodiodes or pyroelectric elements. The band-pass filters 72*c* to 72*f* may be placed between the optical sensors 71*c* to 71*f*, respectively, and the plasma generation region 25. The band-pass filters 72*c* to 72*f* may be configured to transmit a wavelength component of the pulse laser beam 33 at a higher transmittance than other wavelength components. Windows 21*c* to 21*f* may be attached to the chamber 2. The windows 21*c* to 21*f* may be positioned between the scattered light detectors 70*c* to 70*f*, respectively, and the plasma generation region 25.

The EUV collector mirror 23 may be fixed to the plate 82 via the EUV collector mirror holder 81.

4.2 Operation

The target controller 52 of the EUV light generation controller 5 may output a control signal to the target generation unit 26 so that the target generation unit 26 outputs a target 27.

The target generation unit 26 may output a plurality of droplet targets 27 in sequence via the opening 62. The plurality of droplet targets 27 may reach the plasma generation region 25 in the order in which they were outputted. The target collector 28 may be disposed upon a straight line extending from the trajectory of the target 27, and may collect the target 27 having passed through the plasma generation region 25.

The laser controller 50 may receive a target detection signal that is outputted from the target sensor 4.

The laser controller 50 may control the laser system 3 in the following manner.

The laser controller 50 may output a first trigger signal to the delay circuit 53 on the basis of the target detection signal.

Upon receiving the first trigger signal, the delay circuit 53 may output, to the laser system 3, a second trigger signal delayed by a predetermined delay time with respect to the timing of reception of the first trigger signal. The laser system 3 may output a pulse laser beam in accordance with the second trigger signal.

Thus, at a timing when a target 27 reaches the plasma generation region 25 or the vicinity thereof, the pulse laser beam 33 may be focused on the target 27.

The high-reflecting mirror 341 of the laser beam direction control unit 34*a* may be provided in an optical path of the pulse laser beam 31 outputted by the laser system 3. The high-reflecting mirror 341 may reflect the pulse laser beam 31 at a high reflectance.

The high-reflecting mirror 342 may be provided in an optical path of the pulse laser beam reflected by the high-reflecting mirror 341. The high-reflecting mirror 342 may reflect the pulse laser beam at a high reflectance and guide this beam as the pulse laser beam 32 to the focusing optical system 22*a*.

The off-axis paraboloidal mirror 221 of the focusing optical system 22*a* may be provided in an optical path of the pulse laser beam 32. The off-axis paraboloidal mirror 221 may reflect the pulse laser beam 32 toward the flat mirror 222. The flat mirror 222 may reflect the pulse laser beam, which has been reflected by the off-axis paraboloidal mirror 221, as the pulse laser beam 33 toward the plasma generation region 25 or the vicinity thereof. The pulse laser beam 33 may be concentrated to the plasma generation region 25 or the vicinity thereof in conformance with the shape of a reflective surface of the off-axis paraboloidal mirror 221.

In the plasma generation region 25 or the vicinity thereof, a single target 27 may be irradiated with the pulse laser beam 33. Irradiation of a droplet target 27 with the pulse laser beam 33 may cause the droplet target 27 to turn into plasma to generate EUV light.

Further, scattered light may reach the plurality of scattered light detectors 70*c* to 70*f* from the droplet target 27 irradiated with the pulse laser beam 33.

The plurality of scattered light detectors 70*c* to 70*f* may detect the scattered light of the pulse laser beam 33 by detecting a wavelength component of the pulse laser beam 33. Results of detection by the plurality of scattered light detectors 70*c* to 70*f* may be outputted to the optical path controller 51. The optical path controller 51 may determine, on the basis of the results of detection of the scattered light detected by the plurality of scattered light detectors 70*c* to 70*f*, whether the pulse laser beam 33 has struck an acceptable range including a center of the target 27.

Figure 4:
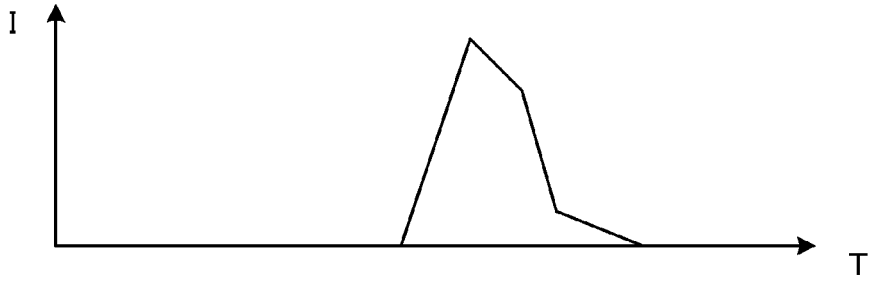
FIG. 4 is a waveform chart of a pulse waveform of scattered light of a pulse laser beam which is detected by one of a plurality of scattered light detectors illustrated in FIG. 3.

FIG. 4 is a waveform chart of a pulse waveform of scattered light of the pulse laser beam 33 which is detected by one of the plurality of scattered light detectors 70*c* to 70*f* illustrated in FIG. 3. In FIG. 4, the horizontal axis represents time T, and the vertical axis represents light intensity I. The plurality of scattered light detectors 70*c* to 70*f* may output, to the optical path controller 51, a peak value of the light intensity I in such a pulse waveform of scattered light. Alternatively, the plurality of scattered light detectors 70*c* to 70*f* may output, to the optical path controller 51, an integrated value of the light intensity I in such a pulse waveform of scattered light with the time T. This integrated value may correspond to energy of scattered light received by the scattered light detectors 70*c* to 70*f*.

Figure 5A:
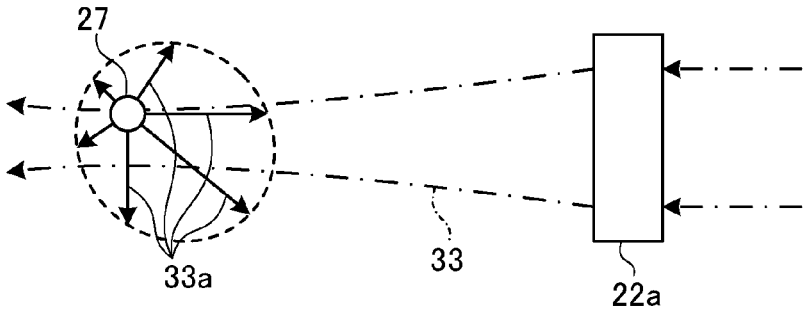
FIG. 5A is a diagram explaining a distribution of scattered light from a target having been irradiated with a pulse laser beam.
Figure 5B:
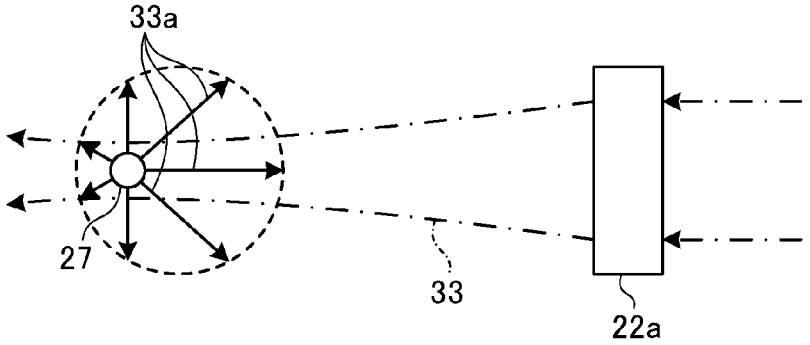
FIG. 5B is a diagram explaining a distribution of scattered light from a target having been irradiated with a pulse laser beam.
Figure 5C:
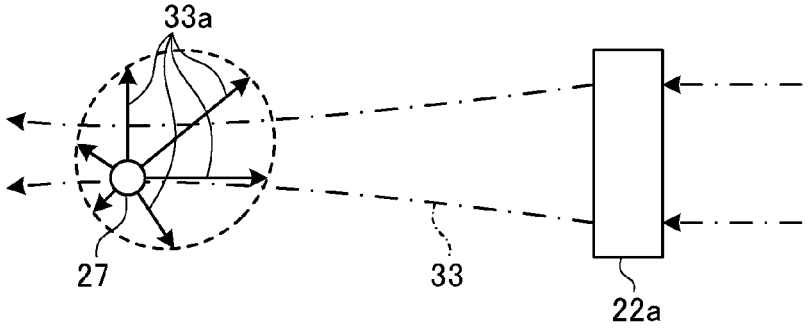
FIG. 5C is a diagram explaining a distribution of scattered light from a target having been irradiated with a pulse laser beam.

FIGS. 5A to 5C are each a diagram explaining a distribution of scattered light from a target 27 having been irradiated with a pulse laser beam. In a case where a pulse laser beam 33 concentrated by the focusing optical system 22*a* has struck a droplet target 27, scattered light 33*a* may travel in multiple directions from a surface of the target 27. The length of an arrow in each direction which indicates the scattered light 33*a*, or the distance from the target 27 to a broken line surrounding the target 27, corresponds to the light intensity I of the scattered light in each direction.

First, assume that, as shown in FIG. 5B, the optical path axis of the pulse laser beam 33 and the center of the target 27 substantially coincide with each other. In this case, the scattered light 33*a* may have an axisymmetric light intensity distribution with respect to the optical path axis of the pulse laser beam 33. On the other hand, assumed that, as shown in FIG. 5A, the optical path axis of the pulse laser beam 33 is dislocated in a downward direction of FIG. 5A from the center of the target 27. In this case, the scattered light 33*a* does not have an axisymmetric light intensity distribution with respect to the optical path axis of the pulse laser beam 33, but may have a light intensity distribution in which a light intensity in the downward direction of FIG. 5A is higher than light intensities in other directions. As shown in FIG. 5C, in a case where the optical path axis of the pulse laser beam 33 is dislocated in an upward direction of FIG. 5C from the center of the target 27, the scattered light 33*a* may have a light intensity distribution in which a light intensity in the upward direction of FIG. 5C is higher than light intensities in other directions.

There may be a similar change in the light intensity distribution of the scattered light 33*a* not only in a case where the optical path axis of the pulse laser beam 33 is dislocated in an upward or downward direction but also in a case where it is dislocated in any direction, provided such a direction is orthogonal to the optical path axis of the pulse laser beam 33. Therefore, it is desirable that the plurality of scattered light detectors 70*c* to 70*f* be arranged in axisymmetric positions with respect to the optical path axis of the pulse laser beam 33. This makes it possible to detect the scattered light 33*a* in each position and thus detect the light intensity distribution of the scattered light 33*a*. This in turn makes it possible to determine whether a gap between the optical path axis of the pulse laser beam 33 and the center of the target 27 falls within an acceptable range. Alternatively, an amount of gap between the optical path axis of the pulse laser beam 33 and the center of the target 27 may be determined according to the light intensity distribution of the scattered light 33*a*.

4.3 Control of Optical Path of Pulse Laser Beam

Figure 6:
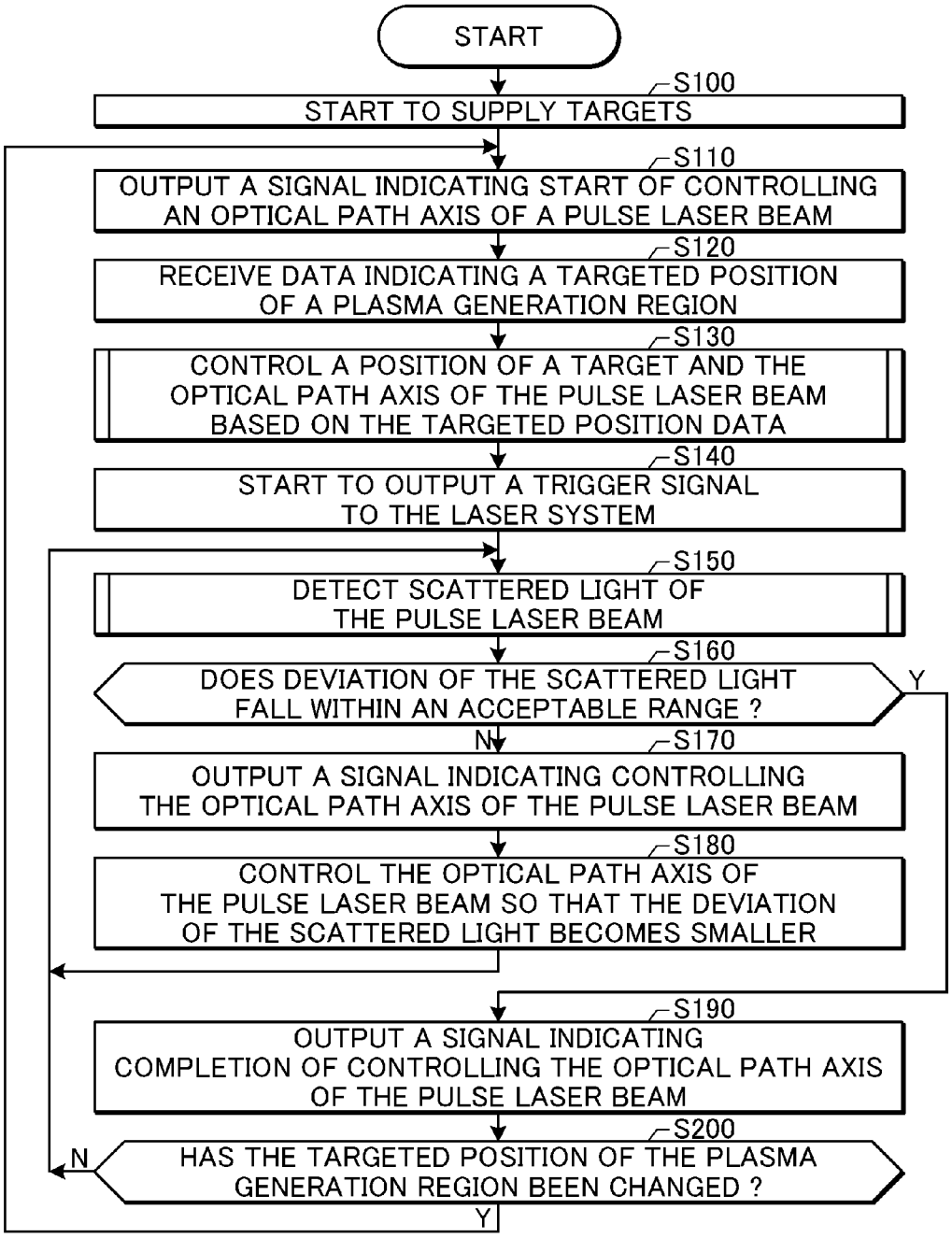
FIG. 6 is a flowchart illustrating an operation of an EUV light generation controller according to the first embodiment.
Figure 7:
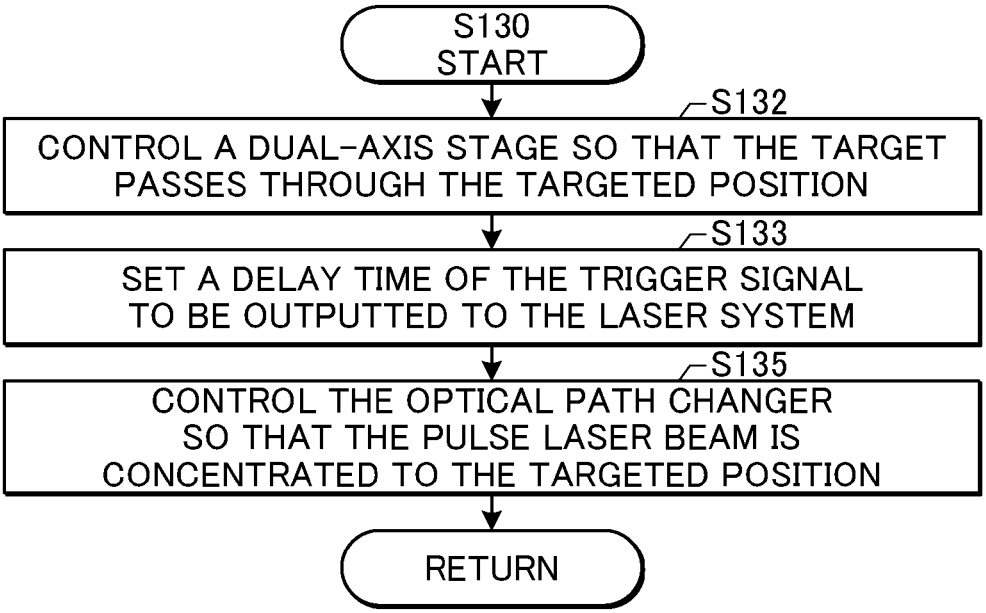
FIG. 7 is a flowchart illustrating details of a process of control based on a targeted position illustrated in FIG. 6.
Figure 8:
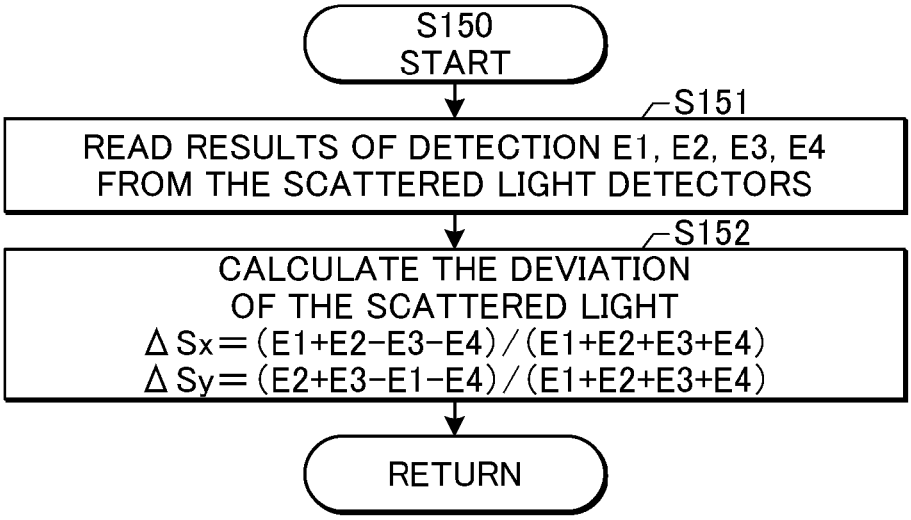
FIG. 8 is a flowchart illustrating details of a process for detecting scattered light illustrated in FIG. 6.

FIG. 6 is a flowchart illustrating an operation of the EUV light generation controller 5 according to the first embodiment. The EUV light generation controller 5 may perform the following process to detect whether a gap between a center of a target and an optical path axis of a pulse laser beam falls within an acceptable range. Further, the EUV light generation controller 5 may perform the following process to change an optical path of the pulse laser beam so that the gap between the center of the target and the optical path axis of the pulse laser beam falls within the acceptable range. In FIGS. 6 to 8, operations of the laser controller 50, the optical path controller 51, and the target controller 52 are collectively described as the operation of the EUV light generation controller 5.

The process illustrated in FIG. 6 may start when the EUV light generation controller 5 has received an EUV light output command signal from the exposure apparatus 6. The process illustrated in FIG. 6 may end when the EUV light generation controller 5 has received an EUV light output stop signal from the exposure apparatus 6.

First, the EUV light generation controller 5 may control the target generation unit 26 to start the supply of targets 27 into the chamber 2 (step S100). The target generation unit 26 may supply a plurality of droplet targets 27 in sequence into the chamber 2.

Next, the EUV light generation controller 5 may output, to the exposure apparatus 6, a signal indicating that the EUV light generation controller 5 starts to control an optical path axis of a pulse laser beam (step S110).

Next, the EUV light generation controller 5 may receive, from the exposure apparatus 6, data indicating a targeted position of the plasma generation region 25 (step S120).

Next, the EUV light generation controller 5 may control the position of each target 27 and the optical path axis of the pulse laser beam on the basis of the targeted position data received from the exposure apparatus 6 (step S130). Details of this process will be described later with reference to FIG. 7.

Next, the EUV light generation controller 5 may start to output a first trigger signal from the laser controller 50 to the delay circuit 53 and thereby start to output a second trigger signal from the delay circuit 53 to the laser system 3 (step S140). The first trigger signal may be outputted on the basis of a target detection signal received from the target sensor 4. The second trigger signal may be a signal delayed by a predetermined delay time with respect to the first trigger signal.

Next, the EUV light generation controller 5 may detect scattered light of the pulse laser beam using the plurality of scattered light detectors 70*c* to 70*f* (step S150). In particular, the EUV light generation controller 5 may calculate a deviation of the scattered light of the pulse laser beam. Details of this process will be described later with reference to FIG. 8.

Next, the EUV light generation controller 5 may determine whether the deviation of the scattered light of the pulse laser beam falls within an acceptable range (step S160). If, in step S160, the deviation of the scattered light of the pulse laser beam does not fall within the acceptable range (step S160; NO), the EUV light generation controller 5 may proceed to step S170.

In step S170, the EUV light generation controller 5 may output, to the exposure apparatus 6, a signal indicating that the EUV light generation controller 5 is controlling the optical path axis of the pulse laser beam. This signal may notify the exposure apparatus 6 that even when EUV light is generated, the energy of the EUV light or the position of emission of the EUV light may not be appropriate.

Next, the EUV light generation controller 5 may control the optical path axis of the pulse laser beam so that the deviation of the scattered light of the pulse laser beam becomes smaller (step S180). The control of the optical path axis of the pulse laser beam may be exercised by driving the optical path changer 84.

Next, the EUV light generation controller 5 may return to step S150 to detect the scattered light again. The EUV light generation controller 5 may repeat steps S150 to S180 to control the optical path axis of the pulse laser beam so that the deviation of the scattered light becomes smaller.

If, in step S160, the deviation of the scattered light of the pulse laser beam falls within the acceptable range (step S160; YES), the EUV light generation controller 5 may proceed to step S190.

In step S190, the EUV light generation controller 5 may output, to the exposure apparatus 6, a signal indicating that the EUV light generation controller 5 has completed the control of the optical path axis of the pulse laser beam. This signal may notify the exposure apparatus 6 that the EUV light generation system 11 is capable of generating EUV light that the exposure apparatus 6 may use for exposure of a semiconductor wafer. For example, the exposure apparatus 6 may perform an exposure operation during a period of time from reception of this signal to reception of a signal indicating that the EUV light generation controller 5 is controlling the optical path axis of the pulse laser beam in S170.

Next, the EUV light generation controller 5 may determine whether the targeted position of the plasma generation region 25 has been changed (step S200). This determination may be made on the basis of a signal that is received from the exposure apparatus 6.

If, in step S200, the targeted position of the plasma generation region 25 has not been changed (step S200; NO), the EUV light generation controller 5 may return to step S150 to detect the scattered light again. If the deviation of the scattered light falls within the acceptable range (step S160; YES), the EUV light generation controller 5 may repeat steps S150, S160, S190, and S200 to continuously monitor the deviation of the scattered light. If the deviation of the scattered light falls out of the acceptable range (step S160; NO), the EUV light generation controller 5 may repeat steps S150 to S160 to control the optical path axis of the pulse laser beam so that the deviation of the scattered light becomes smaller.

If, in step S200, the targeted position of the plasma generation region 25 has been changed (step S200; YES), the EUV light generation controller 5 may return to step S110. Then, the EUV light generation controller 5 may output, to the exposure apparatus 6, a signal indicating that the EUV light generation controller 5 starts to control the optical path axis of the pulse laser beam (step S110) and receive data indicating the targeted position of the plasma generation region 25 (step S120).

This process may be repeated until the reception of the EUV light output stop signal from the exposure apparatus 6.

FIG. 7 is a flowchart illustrating details of the process of control based on the targeted position illustrated in FIG. 6. The process illustrated in FIG. 7 may be performed by the EUV light generation controller 5 as a subroutine of step S130 illustrated in FIG. 6.

First, the EUV light generation controller 5 may control the dual-axis stage 63 of the target generation unit 26 so that a target 27 passes through a targeted position (step S132). The targeted position here may be the same as the targeted position received in step S120. By controlling the dual-axis stage 63, the X-direction position and Z-direction position of the target 27 may be controlled.

Next, the EUV light generation controller 5 may set a delay time of a trigger signal that is outputted to the laser system 3 (step S133). This delay time may be a delay time of the second trigger signal that the delay circuit 53 outputs in response to the first trigger signal based on the target detection signal. This delay time may be set so that the pulse laser beam is focused at a timing when the target 27 reaches the targeted position of the plasma generation region 25. That is, by setting this delay time, the Y-direction position of the target 27 at a point in time where the target 27 is irradiated with the pulse laser beam may be controlled.

Next, the EUV light generation controller 5 may control the optical path axis of the pulse laser beam using the optical path changer 84 so that the pulse laser beam is concentrated to the targeted position (step S135). After that, the process according to this flowchart may end.

This process makes it possible to control the position of the target 27 and the optical path axis of the pulse laser beam so that plasma is generated at the targeted position.

FIG. 8 is a flowchart illustrating details of the process for detecting the scattered light illustrated in FIG. 6. The process illustrated in FIG. 8 may be performed by the EUV light generation controller 5 as a subroutine of step S150 illustrated in FIG. 6.

First, the EUV light generation controller 5 may read results of detection of the scattered light from the plurality of scattered light detectors 70*c* to 70*f* (step S151). The results of detection of the scattered light may be energy of the scattered light. For example, the result of detection by the scattered light detector 70*c*, the result of detection by the scattered light detector 70*d*, the result of detection by the scattered light detector 70*e*, and the result of detection by the scattered light detector 70*f* may be denoted by E1, E2, E3, and E4, respectively.

Next, the EUV light generation controller 5 may calculate the deviation of the scattered light (step S152). As the deviation of the scattered light, an X-direction deviation ΔSx and a Y-direction deviation ΔSy may, for example, be calculated as follows:

$$\Delta Sx=(E1+E2-E3-E4)/(E1+E2+E3+E4); \text{ and}$$

$$\Delta Sy=(E2+E3-E1-E4)/(E1+E2+E3+E4).$$

After that, the process according to this flowchart may end.

This process makes it possible to detect the scattered light of the pulse laser beam and calculate the deviation of the scattered light of the pulse laser beam. In the aforementioned step S160 of determining whether the deviation of the scattered light falls within the acceptable range, the absolute values of ΔSx and ΔSy calculated in step S152 may be compared with a predetermined threshold value. In the aforementioned step S180 of controlling the optical path axis of the pulse laser beam, the optical path changer 84 may be driven so that the optical path axis of the pulse laser beam moves in a direction opposite to the signs of ΔSx and ΔSy calculated in step S152.

Figure 9:
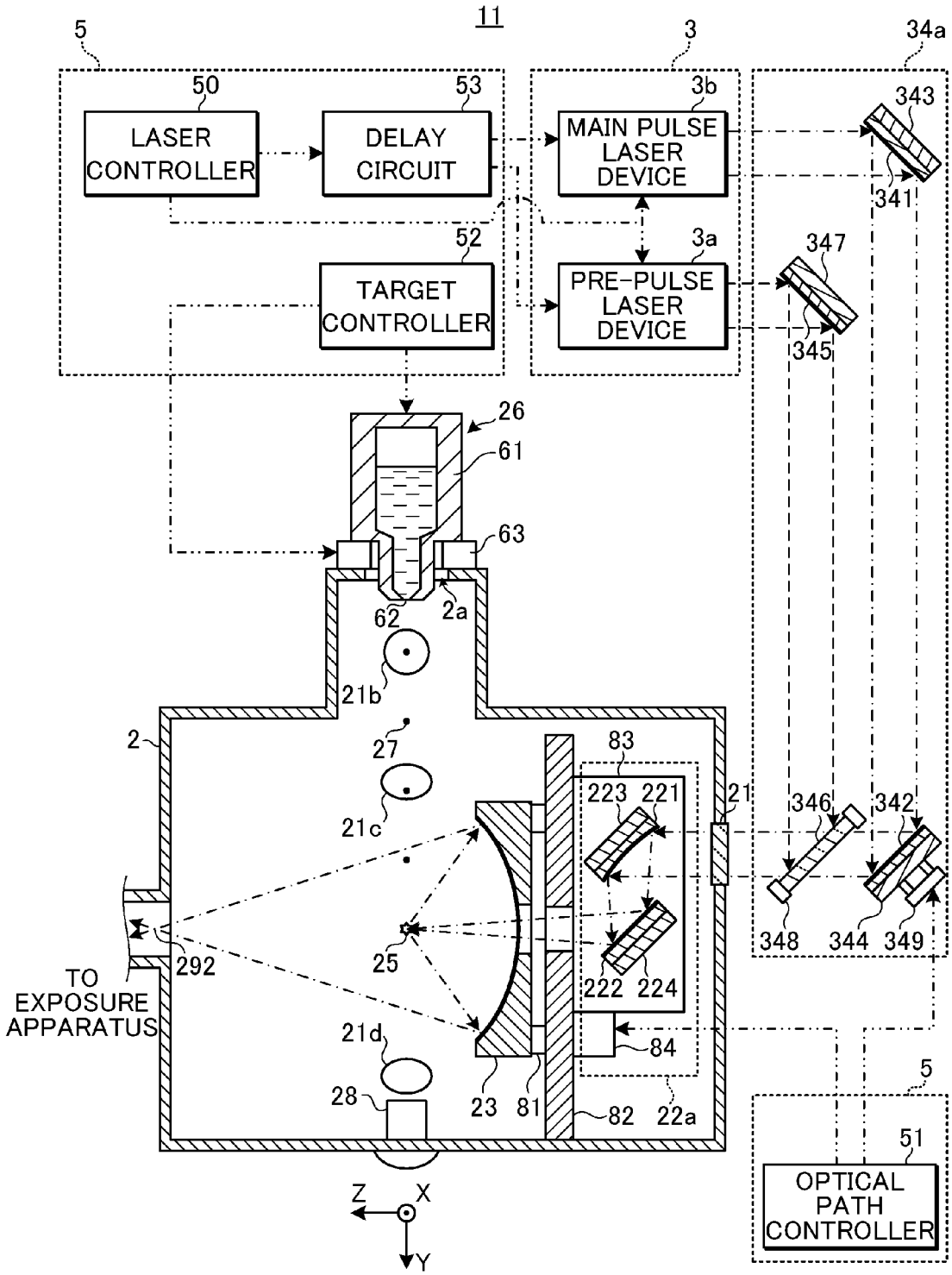
FIG. 9 is a partial cross-sectional view illustrating a configuration of an EUV light generation system according to a second embodiment.

5. EUV Light Generation System Including Pre-pulse Laser Device 5.1 Configuration FIG. 9 is a partial cross-sectional view illustrating a configuration of an EUV light generation system 11 according to a second embodiment. In the second embodiment, the laser system 3 may include a pre-pulse laser device 3*a* and a main pulse laser device 3*b*.

The pre-pulse laser device 3*a* may include a YAG laser device. The main pulse laser device 3*b* may include a $CO_2$ laser device. The pre-pulse laser device 3*a* may correspond to a first pulse laser device that outputs a first pulse laser beam. The main pulse laser device 3*b* may correspond to a second pulse laser device that outputs a second pulse laser beam.

A high-reflecting mirror 345 may be positioned in an optical path of the first pulse laser beam outputted from the pre-pulse laser device 3*a*. The high-reflecting mirror 345 may be supported by a holder 347. The high-reflecting mirrors 341 and 342 may be positioned in an optical path of the second pulse laser beam outputted from the main pulse laser device 3*b*.

A beam combiner 346 may be placed at a position where the optical path of the first pulse laser beam reflected by the high-reflecting mirror 345 and the optical path of the second pulse laser beam reflected by the high-reflecting mirror 342 intersect. The beam combiner 346 may be supported by a holder 348. The beam combiner 346 may reflect, at a high reflectance, a wavelength component of the first pulse laser beam coming from the upper side in FIG. 9 and guide the first pulse laser beam to the focusing optical system 22*a*. The beam combiner 346 may transmit, at a high transmittance, a wavelength component of the second pulse laser beam coming from the right side in FIG. 9 and guide the second pulse laser beam to the focusing optical system 22*a*. The optical path changer 84 provided in the focusing optical system 22*a* may be capable of simultaneously changing the optical path of the first pulse laser beam and the optical path of the second pulse laser beam.

The holder 344 of the high-reflecting mirror 342 is provided with an actuator 349 in order to change the optical path of the second pulse laser beam. The actuator 349 may be configured to be driven in accordance with a control signal from the optical path controller 51 of the EUV light generation controller 5. Driving the actuator 349 may change the tilt of the high-reflecting mirror 342 supported by the holder 344. The change in the tilt of the high-reflecting mirror 342 may lead to a change in the optical path of the second pulse laser beam. The actuator 349 may correspond to a second optical path changer.

In the second embodiment, the delay circuit 53 may output, to the pre-pulse laser device 3*a*, a second trigger signal delayed by a first delay time with respect to a first trigger signal outputted from the laser controller 50. Furthermore, the delay circuit 53 may output, to the main pulse laser device 3*b*, a third trigger signal delayed by a second delay time with respect to the first trigger signal. The second delay time may be longer than the first delay time. The pre-pulse laser device 3*a* and the main pulse laser device 3*b* may output the first and second pulse laser beams in accordance with the respective trigger signals.

Figure 10:
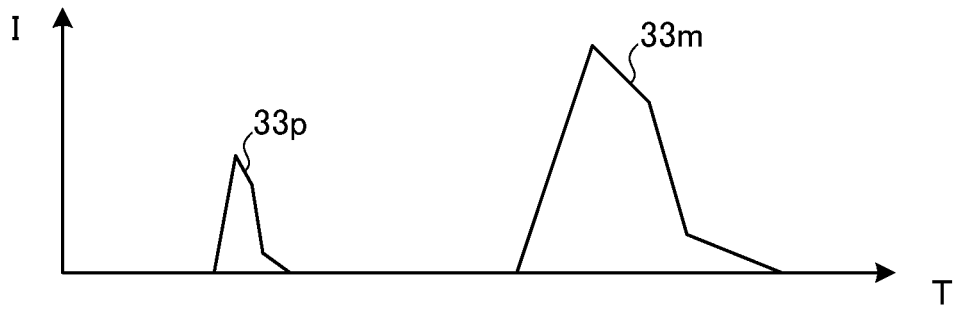
FIG. 10 is a waveform chart of a pulse waveform of scattered light of first and second pulse laser beams which are detected by one of a plurality of scattered light detectors according to the second embodiment.

FIG. 10 is a waveform chart of a pulse waveform of scattered light of the first and second pulse laser beams which is detected by one of the plurality of scattered light detectors 70*c* to 70*f* according to the second embodiment. In FIG. 10, the horizontal axis represents time T, and the vertical axis represents light intensity I. Each of the plurality of scattered light detectors 70*c* to 70*f* according to the second embodiment may be configured to be capable of detecting both a wavelength component of scattered light of the first pulse laser beam and a wavelength component of scattered light of the second pulse laser beam. The respective optical sensors 71*c* to 71*f* of the plurality of scattered light detectors 70*c* to 70*f* may be pyroelectric elements.

As shown in FIG. 10, there may be a predetermined time difference between a timing of the output of a first pulse laser beam 33*p* from the pre-pulse laser device 3*a* and a timing of the output of a second pulse laser beam 33*m* from the main pulse laser device 3*b*. This time difference may correspond to a difference between the first delay time and the second delay time.

Figure 11:
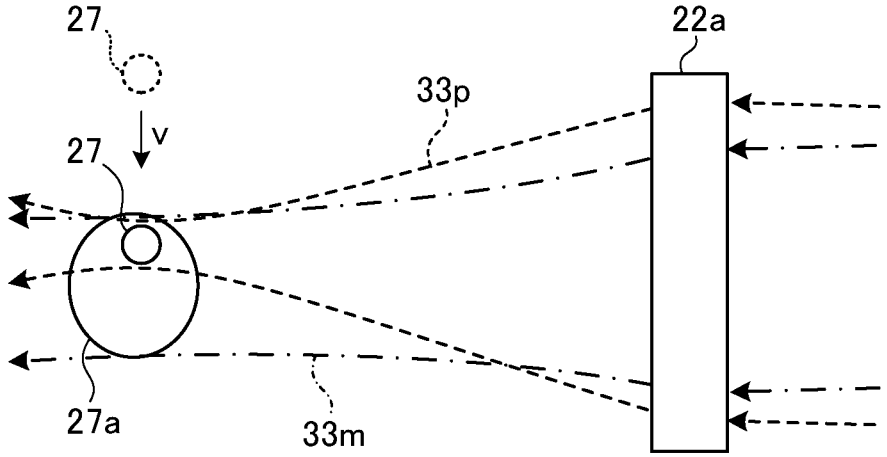
FIG. 11 is a diagram explaining an appearance of a target irradiated with the first and second pulse laser beams.

FIG. 11 is a diagram explaining an appearance of a target irradiated with first and second pulse laser beams. A target 27 may move at a velocity v in a downward direction in FIG. 11. When the target 27 reaches a first position indicated by a solid line in FIG. 11, the target 27 may be irradiated with the first pulse laser beam 33*p* outputted from the pre-pulse laser device 3*a*.

The target 27 irradiated with the first pulse laser beam 33*p* may be broken and diffused by energy of the first pulse laser beam 33*p* to become a secondary target 27*a* illustrated in FIG. 11. The position of the gravity center of the secondary target 27*a* may move to a position different from the first position by inertia based on the momentum of the target 27 or by the energy of the first pulse laser beam 33*p*. When the position of the gravity center of the secondary target 27*a* reaches a second position, the secondary target 27*a* may be irradiated with the second pulse laser beam 33*m* outputted from the main pulse laser device 3*b*.

Therefore, the first pulse laser beam 33*p* may be concentrated to the first position, and the second pulse laser beam 33*m* may be concentrated to the second position different from the first position. The second position may be the same as the targeted position of the plasma generation region 25.

5.2 Control of Optical Paths of Pulse Laser Beams

Figure 12:
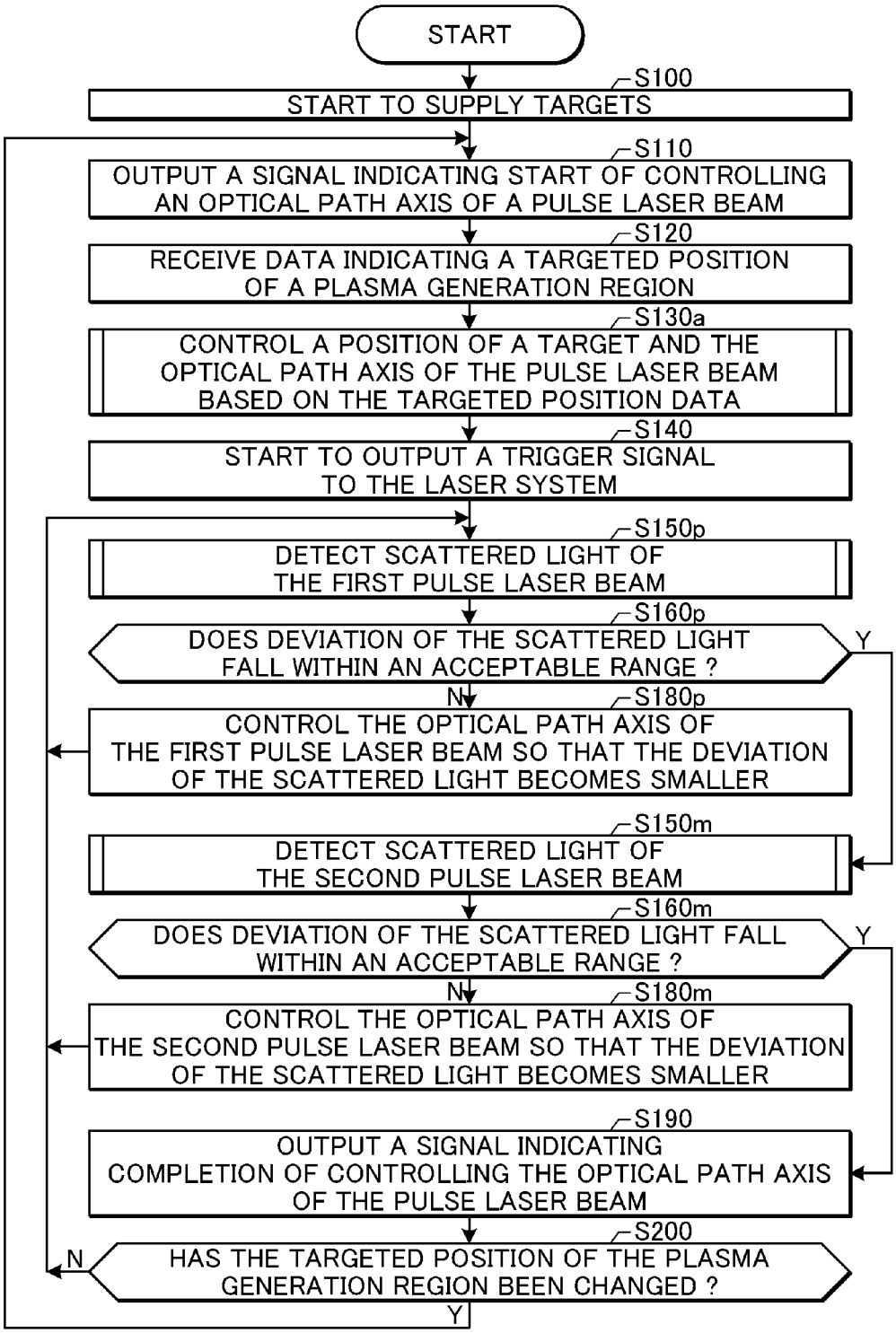
FIG. 12 is a flowchart illustrating an operation of an EUV light generation controller according to the second embodiment.

FIG. 12 is a flowchart illustrating an operation of the EUV light generation controller 5 according to the second embodiment. The operation of the EUV light generation controller 5 according to the second embodiment may be different from that of the first embodiment in terms of a process (step S130*a*) of controlling the position of each target 27 and the optical path axes of the pulse laser beams on the basis of the targeted position data received from the exposure apparatus 6. Further, the operation of the EUV light generation controller 5 according to the second embodiment may be different from that of the first embodiment in terms of a process (step S150*p*) of detecting scattered light of the first pulse laser beam and a process (step S150*m*) of detecting scattered light of the second pulse laser beam. In other respects, the operation of the EUV light generation controller 5 according to the second embodiment may be the same as that of the first embodiment. Operations of the laser controller 50, the optical path controller 51, and the target controller 52 are collectively described as the operation of the EUV ht generation controller 5 in FIGS. 12 and 13.

Figure 13:
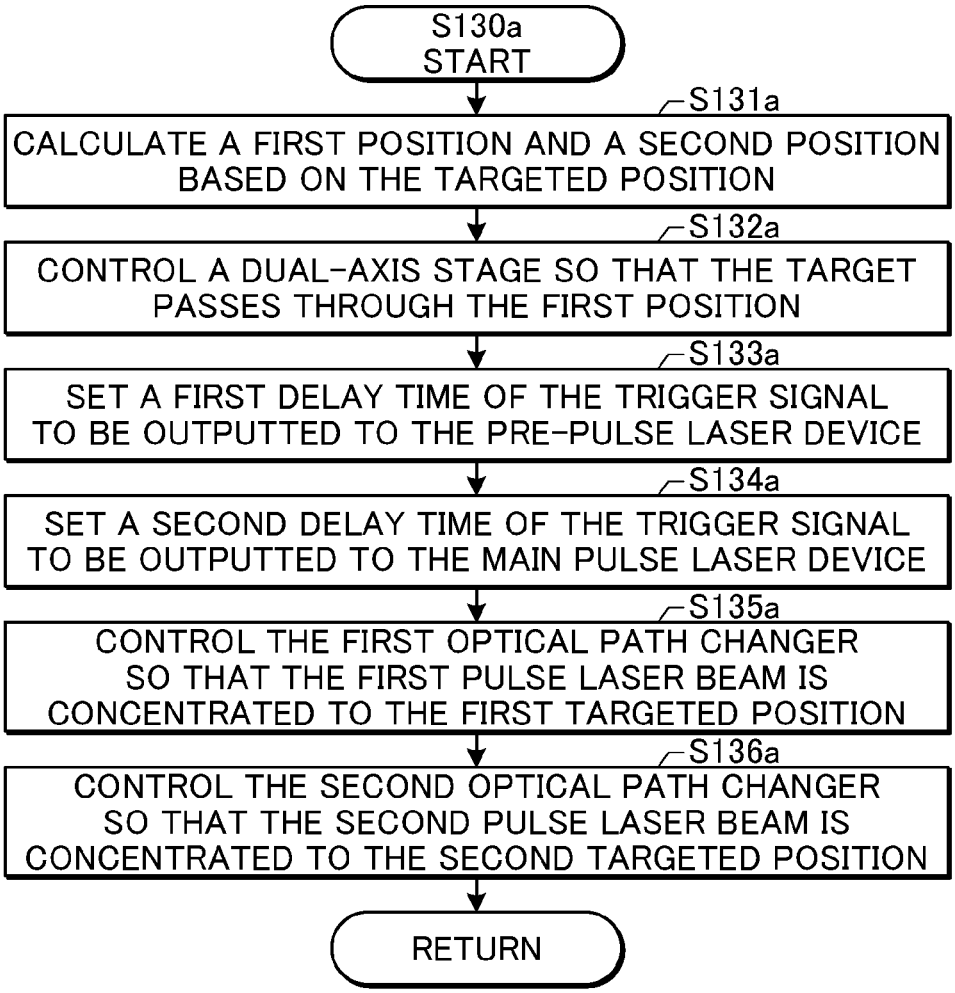
FIG. 13 is a flowchart illustrating details of a process of control based on a targeted position illustrated in FIG. 12.

FIG. 13 is a flowchart illustrating details of the process of control based on the targeted position illustrated in FIG. 12. The process illustrated in FIG. 13 may be performed by the EUV light generation controller 5 as a subroutine of step S130*a* illustrated in FIG. 12.

First, the EUV light generation controller 5 may calculate, on the basis of the targeted position data received from the exposure apparatus 6, the first position to which the first pulse laser beam is concentrated and the second position to which the second pulse laser beam is concentrated (step S131*a*). The first position may be a position apart from the targeted position received from the exposure apparatus 6 by a predetermined amount toward an upstream side of the trajectory of the target 27. The second position may be the same as the targeted position received from the exposure apparatus 6.

Next, the EUV light generation controller 5 may control the dual-axis stage 63 of the target generation unit 25 so that the target 27 passes through the first position (step S132*a*). By controlling the dual-axis stage 63, the X-direction position and Z-direction position of the target 27 may be controlled.

Next, the EUV light generation controller 5 may set a first delay time of a trigger signal that is outputted to the pre-pulse laser device 3*a* (step S133*a*). The first delay time may be a delay time of the second trigger signal that the delay circuit 53 outputs in response to the first trigger signal. The first trigger signal may be based on the target detection signal. The first delay time may be set so that the first pulse laser beam is focused at a timing when the target 27 reaches the first position. That by setting the first delay time, the Y-direction position of the target 27 at a point in time where the target 27 is irradiated with the first pulse laser beam may be controlled.

Next, the EUV light generation controller 5 may set a second delay time of a trigger signal that is outputted to the main pulse laser device 3*b* (step S134*a*). The second delay time may be a delay time of the third trigger signal that the delay circuit 53 outputs in response to the first trigger signal. The first trigger signal may be based on the target detection signal. The second delay time may be set so that a secondary target 27*a* is irradiated with the second pulse laser beam at a timing when the secondary target 27*a* reaches the second position.

Next, the EUV light generation controller 5 may control the optical path axis of the first pulse laser beam using the optical path changer 84 so that the first pulse laser beam is concentrated to the first position (step S135*a*).

Next, the EUV light generation controller 5 may control the optical path axis of the second pulse laser beam, using the actuator 349 arranged at the holder 344 of the high-reflecting mirror 342 so that the second pulse laser beam is concentrated to the second position (step S136*a*).

After that, the process of S130*a* according to this flowchart may end.

With continued reference to FIG. 12, the EUV light generation controller 5 may start to output trigger signals from the delay circuit 53 to the pre-pulse laser device 3*a* and the main pulse laser device 3*b*, respectively (step S140).

Next, the EUV light generation controller 5 may detect scattered light of the first pulse laser beam using the plurality of scattered light detectors 70*c* to 70*f* (step S150*p*). As shown in FIG. 10, a pulse waveform of scattered light that is detected by a scattered light detector may have two peaks having a time difference corresponding to the difference between the first delay time and the second delay time. The first one of these two peaks may correspond to the scattered light of the first pulse laser beam. The EUV light generation controller 5 may calculate a deviation of the scattered light of the first pulse laser beam. This calculation process may be substantially the same as that described with reference to FIG. 8 in the first embodiment.

Next, the EUV light generation controller 5 may determine whether the deviation of the scattered light of the first pulse laser beam falls within an acceptable range (step S160*p*). If, in step S160*p*, the deviation of the scattered light of the first pulse laser beam does not fall within the acceptable range (step S160*p*; NO), the EUV light generation controller 5 may proceed to step S180*p*. Alternatively, as in the first embodiment, the EUV light generation controller 5 may proceed to step S180*p* after having outputted a signal indicating that the EUV light generation controller 5 is controlling the optical path axis of the pulse laser beam.

In step S180*p*, the EUV light generation controller 5 may control the optical path axis of the first pulse laser beam so that the deviation of the scattered light of the first pulse laser beam becomes smaller. The control of the optical path axis of the first pulse laser beam may be exercised by driving the optical path changer 84.

Next, the EUV light generation controller 5 may return to step S150*p* to detect the scattered light of the first pulse laser beam again. The EUV light generation controller 5 may repeat steps S150*p* to S180*p* to control the optical path axis of the first pulse laser beam so that the deviation of the scattered light of the first pulse laser beam becomes smaller.

If, in step S160*p*, the deviation of the scattered light of the first pulse laser beam falls within the acceptable range (step S160*p*; YES), the EUV light generation controller 5 may proceed to step S150*m*.

In step S150*m*, the EUV light generation controller 5 may detect scattered light of the second pulse laser beam using the plurality of scattered light detectors 70*c* to 70*f*. The second of the two peaks of the pulse waveform of the scattered light shown in FIG. 10 may correspond to the scattered light of the second pulse laser beam. The EUV light generation controller 5 may calculate a deviation of the scattered light of the second pulse laser beam. This calculation process may be substantially the same as that described with reference to FIG. 8 in the first embodiment.

Next, the EUV light generation controller 5 may determine whether the deviation of the scattered light of the second pulse laser beam falls within an acceptable range (step 3160*m*). If, in step 3160*m*, the deviation of the scattered light of the second pulse laser beam does not fall within the acceptable range (step 3160*m*; NO), the EUV light generation controller 5 may proceed to step S180*m*. Alternatively, as in the first embodiment, the EUV light generation controller 5 may proceed to step 3180*m* after having outputted a signal indicating that the EUV light generation controller 5 is controlling the optical path axis of the pulse laser beam.

In step S180*m*, the EUV light generation controller 5 may control the optical path axis of the second pulse laser beam so that the deviation of the scattered light of the second pulse laser beam becomes smaller. The control of the optical path axis of the second pulse laser beam may be exercised by driving the actuator 349.

Next, the EUV light generation controller 5 may return to step 3150*p* to detect the scattered light of the first pulse laser beam again. The EUV light generation controller 5 may repeat steps 3150*p* to 3180*m* to control the optical path axes of the first and second pulse laser beams so that a smaller deviation of the scattered light of the first pulse laser beam and a smaller deviation of the scattered light of the second pulse laser beam are detected.

If in step S160*m*, the deviation of the scattered light of the second pulse laser beam falls within the acceptable range (step S160*m*; YES), the EUV light generation controller 5 may proceed to step S190. The subsequent process may be the same as that of the first embodiment.

In the second embodiment, the deviation of the scattered light of the first pulse laser beam and the deviation of the scattered light of the second pulse laser beam may be detected separately. This makes it possible to separately control the optical path axis of the first pulse laser beam and the optical path axis of the second pulse laser beam.

Although the second embodiment has described a case where each of the plurality of scattered light detectors is configured to detect both the scattered light of the first pulse laser beam and the scattered light of the second pulse laser beam, the present disclosure is not limited to this case. A plurality of first scattered light detectors each configured to detect the scattered light of the first pulse laser beam and a plurality of second scattered light detectors each configured to detect the scattered light of the second pulse laser beam may be used.

6. Modifications 6.1 Example of Scattered Light Detector

Figure 14:
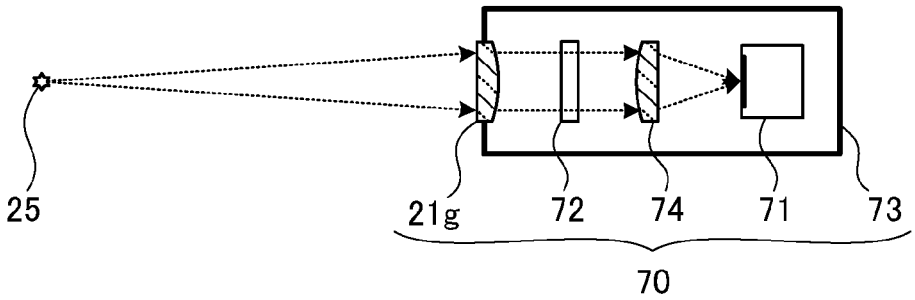
FIG. 14 is a cross-sectional view illustrating a modification of a scattered light detector.

FIG. 14 is a cross-sectional view illustrating a modification of a scattered light detector. In the first or second embodiment, the scattered light detectors may be configured as shown in FIG. 14. A scattered light detector 70 illustrated in FIG. 14 may include an optical sensor 71, a band-pass filter 72, a container 73, a collector lens 74, and a collimating lens 21*g*.

The optical sensor 71, the band-pass filter 72, and the container 73 may be the same as those of the aforementioned scattered light detectors. The collimating lens 21*g* may also serve as a window of the chamber 2. The collimating lens 21*g* may have a focal length substantially equal to a distance from the collimating lens 21*g* to the plasma generation region 25. The collector lens 74 may have a focal length substantially equal to a distance from the collector lens 74 to the light-receiving surface of the optical sensor 71.

The collimating lens 21*g* and the collector lens 74 may transfer an image of the plasma generation region 25 onto the light-receiving surface of the optical sensor 71. Light traveling along an optical path leading from the plasma generation region 25 to the light-receiving surface of the optical sensor 71 may be substantially parallel between the collimating lens 21*g* and the collector lens 74. This makes it possible to improve the selectivity of wavelength by the band-pass filter 72.

6.2 Example Arrangement of Three Scattered Light Detectors

Figure 15:
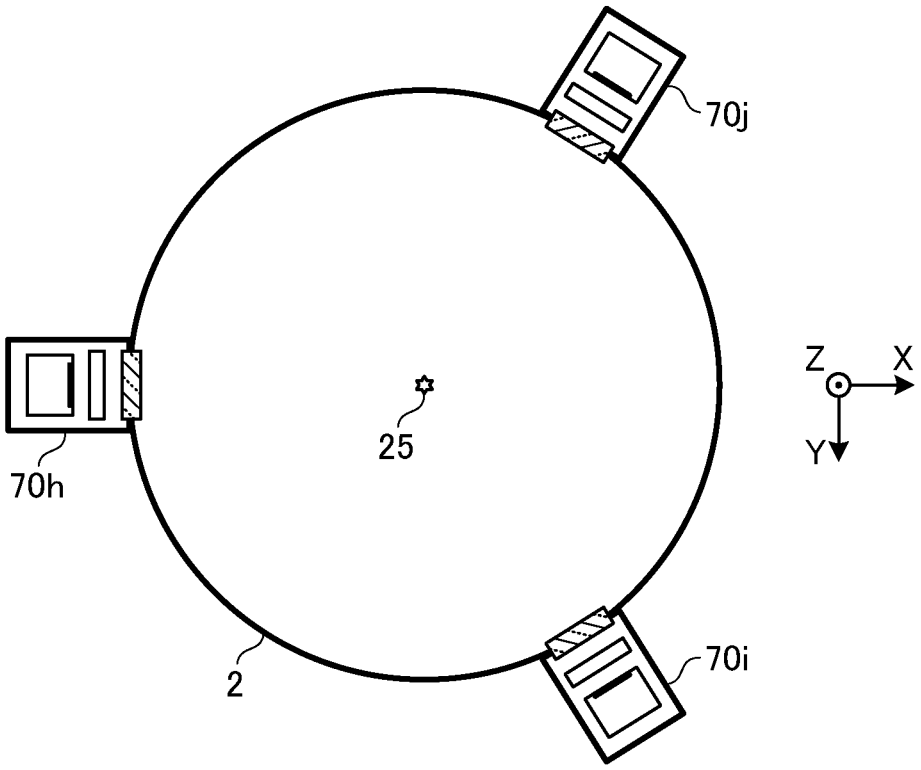
FIG. 15 is a cross-sectional view illustrating a modification relating to an arrangement of scattered light detectors.

FIG. 15 is a cross-sectional view illustrating a modification relating to an arrangement of scattered light detectors. FIG. 15 shows a cross-section taken along a plane parallel to the XY plane. FIG. 15 omits to illustrate the EUV collector mirror 23, the target generation unit 26, the target collector 28, and the like. In the first or second embodiment, the scattered light detectors may be arranged as shown in FIG. 15.

In FIG. 15, three scattered light detectors 70*h*, 70*i*, and 70*j* may be arranged on the plane parallel to the XY plane in such a manner as to be positioned at substantially equal distances from the plasma generation region 25. The three scattered light detectors 70*h*, 70*i*, and 70*j* may be placed at substantially regular intervals from each other. That is, the scattered light detectors 70*h*, 70*i*, and 70*j* may be positioned in directions at an angle of 120 degrees to each other, as seen from a view point in an imaginary line parallel to the Z axis that passes through the plasma generation region 25.

Assuming that E1, E2, and E3 denote results of detection by the scattered light detectors 70*h*, 70*i*, and 70*j*, respectively, an X-direction deviation ΔSx and a Y-direction deviation ΔSy may be calculated as follows:

$$\Delta Sx=[E1-\cos 60^\circ\ (E2+E3)]/[E1+\cos 60^\circ\ (E2+E3)];$$

and $$\Delta Sy=(E2-E3)/(E2+E3).$$

6.3 Example Arrangement of Four Scattered Light Detectors

Figure 16A:
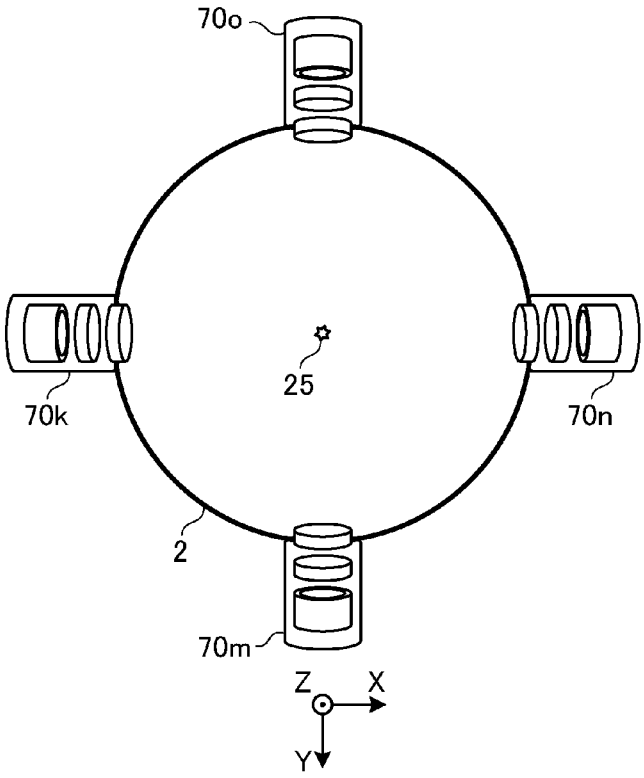
FIGS. 16A and 16B are partial cross-sectional views illustrating another modification relating to an arrangement of scattered light detectors.
Figure 16B:
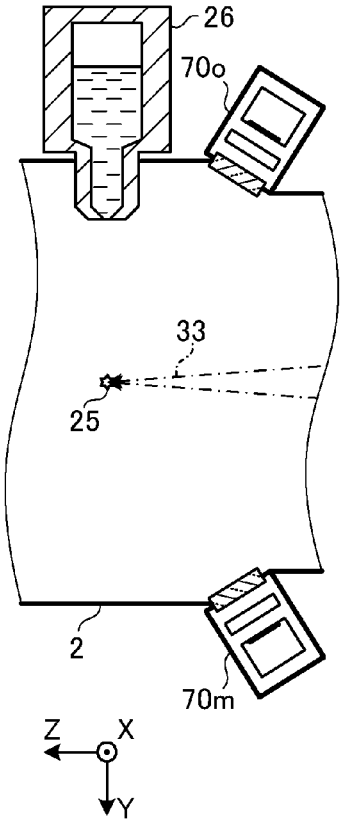

FIGS. 16A and 16B are partial cross-sectional views illustrating another modification relating to an arrangement of scattered light detectors. FIG. 16A shows a cross-section taken along a plane parallel to the XY plane. FIG. 16B shows a cross-section taken along a plane parallel to the YZ plane. FIGS. 16A and 16B omit to illustrate the EUV collector mirror 23, the target collector 28, and the like. In the first or second embodiment, the scattered light detectors may be arranged as shown in FIGS. 16A and 16B.

In FIGS. 16A and 16B, four scattered light detectors 70*k*, 70*m*, 70*n*, and 70*o* may be arranged on the plane parallel to the XY plane in such a manner as to be positioned at substantially equal distances from the plasma generation region 25. As shown in FIG. 16A, the scattered light detectors 70*k* and 70*n* may be positioned in directions parallel to the XZ plane as seen from the plasma generation region 25. Further, the scattered light detectors 70*m* and 70*o* may be positioned in directions parallel to the YZ plane as seen from the plasma generation region 25.

As shown in FIG. 16B, the four scattered light detectors 70*k*, 70*m*, 70*n*, and 70*o* may be arranged in positions shifted in a −Z direction with respect to the plasma generation region 25, i.e., toward the upstream of the optical path of the pulse laser beam. For example, as seen from the plasma generation region 25, the four scattered light detectors 70*k*, 70*m*, 70*n*, and 70*o* may be positioned in directions tilted at approximately 30 degrees to the XY plane. This enables the scattered light detectors to detect strong scattered light, thus bringing about improvement in measurement accuracy.

Assuming that E1, E2, E3, and E4 denote results of detection by the scattered light detectors 70*k*, 70*m*, 70*n*, and 70*o*, respectively, an X-direction deviation ΔSx and a Y-direction deviation ΔSy may be calculated as follows:

$$\Delta Sx=(E1-E3)/(E1+E3);\ \text{and}$$

$$\Delta Sy=(E2-E4)/(E2+E4).$$

7. Configuration of Controller

Figure 17:
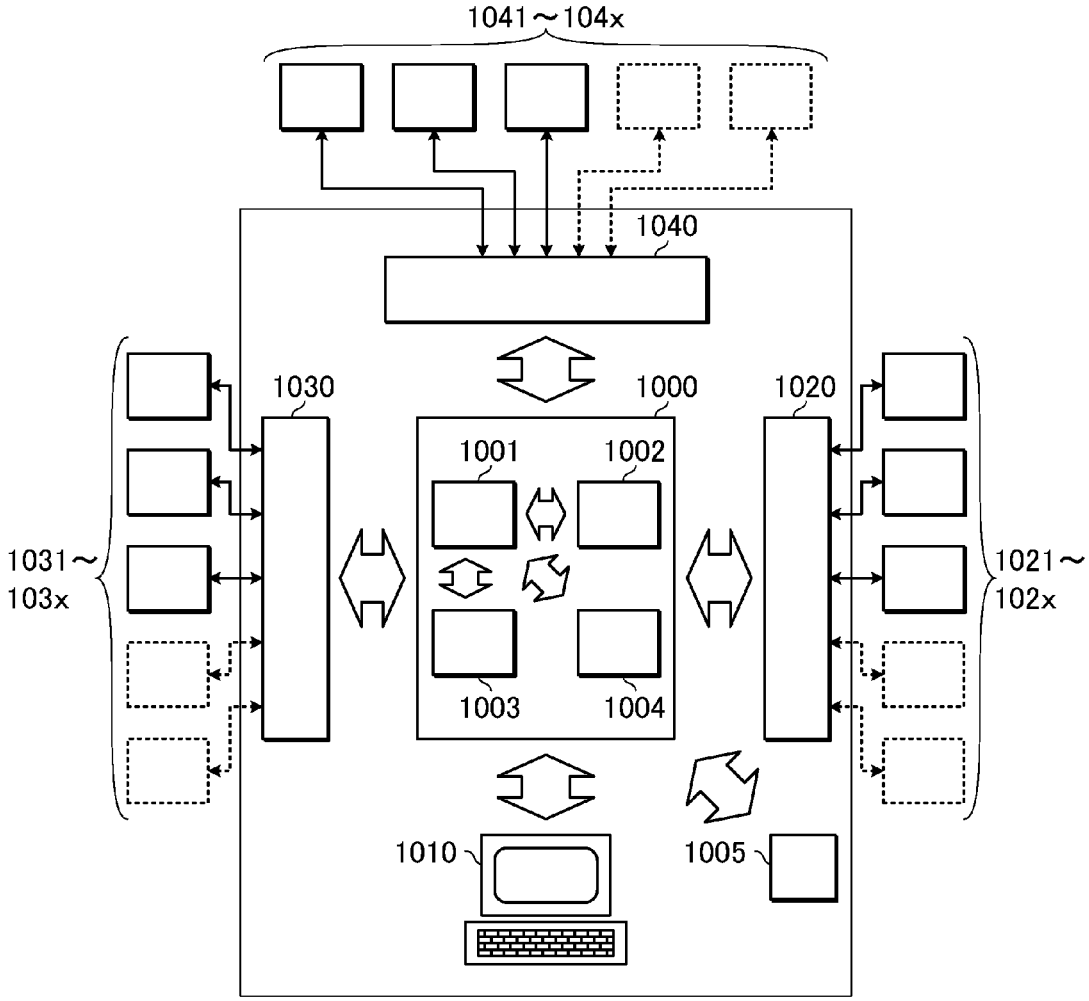
FIG. 17 is a block diagram schematically illustrating an exemplary configuration of a controller.

FIG. 17 is a block diagram schematically illustrating an exemplary configuration of a controller.

Each of the various controllers of the EUV light generation controller 5 in the above-described embodiments may be constituted by a general-purpose control device such as a computer or a programmable controller. For example, the controller may be constituted as described below.

(Configuration)

The controller may include a processing unit 1000, and a storage memory 1005, a user interface 1010, a parallel input/output (I/O) controller 1020, a serial I/O controller 1030, and an analog-to-digital (A/D) and digital-to-analog (D/A) converter 1040 that are connected to the processing unit 1000. The processing unit 1000 may include a central processing unit (CPU) 1001, and a memory 1002, a timer 1003, and a graphics processing unit (GPU) 1004 that are connected to the CPU 1001.

(Operation)

The processing unit 1000 may read out programs stored in the storage memory 1005. The processing unit 1000 may execute read-out programs, read out data from the storage memory 1005 in accordance with the execution of the programs, or store data in the storage memory 1005.

The parallel I/O controller 1020 may be connected to devices 1021 to 102*x* communicable through parallel I/O ports. The parallel I/O controller 1020 may control communication using digital signals through parallel I/O ports that is performed in the process where the processing unit 1000 executes programs.

The serial I/O controller 1030 may be connected to devices 1031 to 103*x* communicable through serial I/O ports. The serial I/O controller 1030 may control communication using digital signals through serial I/O ports that is performed in the process where the processing unit 1000 executes programs.

The A/D and D/A converter 1040 may be connected to devices 1041 to 104*x* communicable through analog ports. The A/D and D/A converter 1040 may control communication using analog signals through analog ports that is performed in the process where the processing unit 1000 executes programs.

The user interface 1010 may be configured to display progress of executing programs by the processing unit 1000 to an operator or to receive instructions by the operator to the processing unit 1000 to stop execution of the programs or to execute interruption processing.

The CPU 1001 of the processing unit 1000 may perform arithmetic processing of programs. In the process where the CPU 1001 executes programs, the memory 1002 may temporally store programs or temporally store data in the arithmetic process. The timer 1003 may measure time or elapsed time to output the time or the elapsed time to the CPU 1001 in accordance with the execution of the programs.

When image data is input to the processing unit 1000, the GPU 1004 may process the image data in accordance with the execution of the programs and output the results to the CPU 1001.

The devices 1021 to 102*x* communicable through parallel I/O ports, which are connected to the parallel I/O controller 1020, may be the laser system 3, the exposure apparatus 6, another controller, or the like.

The devices 1031 to 103*x* communicable through serial I/O ports, which are connected to the serial I/O controller 1030, may be the target sensor 4, the target generation unit 26, or the like.

The devices 1041 to 104*x* communicable through analog ports, which are connected to the A/D and D/A converter 1040, may be various sensors such as the scattered light detectors 70*c* to 70*f*.

With the above-described configuration, the controller may be capable of achieving the operation illustrated in each of the embodiments.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments may be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

The invention claimed is:

1. An extreme ultraviolet light generation system comprising:

a first laser apparatus configured to output a first pulse laser beam;

a second laser apparatus configured to output a second pulse laser beam;

a chamber;

a target generation unit configured to output a target to a predetermined region in the chamber;

a laser controller configured to control the first laser apparatus and the second laser apparatus so that the target is irradiated with the first pulse laser beam, the target being turned into a secondary target by being irradiated with the first pulse laser beam, and so that the secondary target is irradiated with the second pulse laser beam;

a focusing optical system configured to concentrate the first pulse laser beam to the target and concentrate the second pulse laser beam to the secondary target;

a plurality of scattered light detectors each configured to detect both scattered light from the target irradiated with the first pulse laser beam and scattered light from the secondary target irradiated with the second pulse laser beam; and an EUV light generation controller configured to control at least an optical path of the first pulse laser beam on a basis of results of detection of the scattered light from the target irradiated with the first pulse laser beam and then control an optical path of the second pulse laser beam on a basis of results of detection of the scattered light from the secondary target irradiated with the second pulse laser beam.

2. The extreme ultraviolet light generation system according to claim 1, further comprising:

a first optical path changer configured to change at least the optical path of the first pulse laser beam; and a second optical path changer configured to change the optical path of the second pulse laser beam.

3. An extreme ultraviolet light generation system comprising:

a first laser apparatus configured to output a first pulse laser beam;

a second laser apparatus configured to output a second pulse laser beam;

a chamber;

a target generation unit configured to output a target to a predetermined region in the chamber;

a laser controller configured to control the first laser apparatus and the second laser apparatus so that the target is irradiated with the first pulse laser beam, the target being turned into a secondary target by being irradiated with the first pulse laser beam, and so that the secondary target is irradiated with the second pulse laser beam;

a focusing optical system configured to concentrate the first pulse laser beam to the target and concentrate the second pulse laser beam to the secondary target;

a plurality of first scattered light detectors each configured to detect scattered light from the target irradiated with the first pulse laser beam;

a plurality of second scattered light detectors each configured to detect scattered light from the secondary target irradiated with the second pulse laser beam; and an EUV light generation controller configured to control at least an optical path of the first pulse laser beam on a basis of results of detection by the respective first scattered light detectors and then control an optical path of the second pulse laser beam on a basis of results of detection by the respective second scattered light detectors.

4. The extreme ultraviolet light generation system according to claim 3, further comprising:

a first optical path changer configured to change at least the optical path of the first pulse laser beam; and a second optical path changer configured to change the optical path of the second pulse laser beam.

5. An extreme ultraviolet light generation system comprising:

a first laser apparatus configured to output a first pulse laser beam;

a second laser apparatus configured to output a second pulse laser beam;

a chamber;

a target generation unit configured to output a target to a predetermined region in the chamber;

a laser controller configured to control the first laser apparatus and the second laser apparatus so that the target is irradiated with the first pulse laser beam, the target being turned into a secondary target by being irradiated with the first pulse laser beam, and so that the secondary target is irradiated with the second pulse laser beam;

a focusing optical system configured to concentrate the first pulse laser beam to the target and concentrate the second pulse laser beam to the secondary target;

a plurality of scattered light detectors each configured to detect scattered light from the target irradiated with the first pulse laser beam and scattered light from the secondary target irradiated with the second pulse laser beam and output data on a waveform including a first peak and a second peak coming after the first peak; and an EUV light generation controller configured to control at least an optical path of the first pulse laser beam on a basis of the first peaks of the waveforms outputted by the respective scattered light detectors and control an optical path of the second pulse laser beam on a basis of the second peaks of the waveforms outputted by the respective scattered light detectors.

6. The extreme ultraviolet light generation system according to claim 5, further comprising:

a first optical path changer configured to change at least the optical path of the first pulse laser beam; and a second optical path changer configured to change the optical path of the second pulse laser beam.

7. The extreme ultraviolet light generation system according to claim 2, wherein the EUV light generation controller is configured to control the first optical path changer on the basis of the results of detection of the scattered light from the target irradiated with the first pulse laser beam and control the second optical path changer on the basis of the results of detection of the scattered light from the secondary target irradiated with the second pulse laser beam.

8. The extreme ultraviolet light generation system according to claim 2, wherein the EUV light generation controller is configured to control the first optical path changer so as to reduce deviation of the results of detection of the scattered light from the target irradiated with the first pulse laser beam and control the second optical path changer so as to reduce deviation of the results of detection of the scattered light from the secondary target irradiated with the second pulse laser beam.

9. The extreme ultraviolet light generation system according to claim 2, wherein the first optical path changer is configured to change both the optical path of the first pulse laser beam and the optical path of the second pulse laser beam.

10. The extreme ultraviolet light generation system according to claim 1, wherein each of the scattered light detectors includes a pyroelectric element.

11. The extreme ultraviolet light generation system according to claim 1, wherein each of the scattered light detectors is configured to output data on a waveform including a first peak and a second peak coming after the first peak, and the EUV light generation controller is configured to control at least the optical path of the first pulse laser beam on a basis of the first peaks of the waveforms outputted by the respective scattered light detectors and control the optical path of the second pulse laser beam on a basis of the second peaks of the waveforms outputted by the respective scattered light detectors.

12. The extreme ultraviolet light generation system according to claim 4, wherein the EUV light generation controller is configured to control the first optical path changer on the basis of the results of detection by the respective first scattered light detectors and control the second optical path changer on the basis of the results of detection by the respective second scattered light detectors.

13. The extreme ultraviolet light generation system according to claim 4, wherein the EUV light generation controller is configured to control the first optical path changer so as to reduce deviation of the results of detection by the respective first scattered light detectors and control the second optical path changer so as to reduce deviation of the results of detection by the respective second scattered light detectors.

14. The extreme ultraviolet light generation system according to claim 4, wherein the first optical path changer is configured to change both the optical path of the first pulse laser beam and the optical path of the second pulse laser beam.

15. The extreme ultraviolet light generation system according to claim 3, wherein each of the first scattered light detectors and the second scattered light detectors includes a pyroelectric element.

16. The extreme ultraviolet light generation system according to claim 6, wherein the EUV light generation controller is configured to control the first optical path changer on the basis of the first peaks of the waveforms detected by the respective scattered light detectors and control the second optical path changer on the basis of the second peaks of the waveforms detected by the respective scattered light detectors.

17. The extreme ultraviolet light generation system according to claim 6, wherein the EUV light generation controller is configured to control the first optical path changer so as to reduce deviation of the first peaks of the waveforms detected by the respective scattered light detectors and control the second optical path changer so as to reduce deviation of the second peaks of the waveforms detected by the respective scattered light detectors.

18. The extreme ultraviolet light generation system according to claim 6, wherein the first optical path changer is configured to change both the optical path of the first pulse laser beam and the optical path of the second pulse laser beam.

19. The extreme ultraviolet light generation system according to claim 5, wherein each of the scattered light detectors includes a pyroelectric element.

* * * * *